US008418461B2

(12) United States Patent
Siuchta

(10) Patent No.: US 8,418,461 B2
(45) Date of Patent: Apr. 16, 2013

(54) SYSTEM AND METHOD FOR CONDENSATE REMOVAL FROM EGR SYSTEM

(75) Inventor: Grzegorz Siuchta, Des Plaines, IL (US)

(73) Assignee: International Engine Intellectual Property Company, LLC, Lisle, IL (US)

( * ) Notice: Subject to any disclaimer, the term of this patent is extended or adjusted under 35 U.S.C. 154(b) by 692 days.

(21) Appl. No.: 12/573,918

(22) Filed: Oct. 6, 2009

(65) Prior Publication Data

US 2011/0079002 A1 Apr. 7, 2011

(51) Int. Cl.
*F02B 33/44* (2006.01)

(52) U.S. Cl.
USPC ..... 60/605.1; 60/605.2

(58) Field of Classification Search ..... 60/605.1, 60/605.2
See application file for complete search history.

(56) References Cited

U.S. PATENT DOCUMENTS

| | | | | |
|---|---|---|---|---|
| 6,367,256 | B1 * | 4/2002 | McKee | 60/605.2 |
| 7,251,937 | B2 * | 8/2007 | Appleton | 60/599 |
| 7,451,750 | B1 * | 11/2008 | Fox et al. | 123/568.12 |
| 7,740,010 | B2 * | 6/2010 | Fulton et al. | 123/698 |
| 8,015,809 | B2 * | 9/2011 | Watson | 60/605.2 |
| 2004/0079079 | A1 * | 4/2004 | Martin et al. | 60/605.2 |
| 2006/0124115 | A1 * | 6/2006 | Brookshire et al. | 123/568.12 |
| 2006/0130470 | A1 * | 6/2006 | Dorn et al. | 60/309 |
| 2009/0013977 | A1 * | 1/2009 | Brecheisen, II | 123/563 |
| 2009/0271094 | A1 * | 10/2009 | Stablein et al. | 701/108 |
| 2010/0263360 | A1 * | 10/2010 | Le Flem et al. | 60/309 |
| 2011/0173954 | A1 * | 7/2011 | Wenzel | 60/274 |

FOREIGN PATENT DOCUMENTS

| | | | |
|---|---|---|---|
| DE | 102008045479 | A1 * | 3/2010 |
| EP | 1548269 | A1 * | 6/2005 |
| EP | 2161438 | A2 * | 3/2010 |

* cited by examiner

*Primary Examiner* — Kenneth Bomberg
*Assistant Examiner* — Paolo Isada
(74) *Attorney, Agent, or Firm* — Mark C. Bach; Jeffrey P. Calfa

(57) ABSTRACT

An exhaust gas recirculation system for an engine having an exhaust system includes an EGR cooler in fluid communication with an exhaust manifold. The EGR cooler receives a portion of the engine's exhaust gas. A cooled EGR passage is downstream of the EGR cooler, and an air intake line is in fluid communication with an intake manifold. A collecting vessel is located at or downstream of the EGR cooler for receiving condensate, and a condensate evacuation line is in fluid communication with the collecting vessel for receiving condensate from the collecting vessel.

6 Claims, 2 Drawing Sheets

SYSTEM AND METHOD FOR CONDENSATE REMOVAL FROM EGR SYSTEM

BACKGROUND

Embodiments described herein relate generally to exhaust gas recirculation (EGR) systems in vehicles. More specifically, embodiments described herein relate to condensate removal from EGR systems in vehicles.

Exhaust gas recirculation (EGR) is used to reduce nitrogen oxide (NOx) emissions in both gasoline and diesel engines. NOx is primarily formed when a mix of nitrogen and oxygen is subjected to high temperatures. EGR systems recirculate a portion of an engine's exhaust gas back to the engine cylinders. Intermixing fresh, incoming air with recirculated exhaust gas dilutes the mix, which lowers the flame temperature and reduces the amount of excess oxygen. The exhaust gas also increases the specific heat capacity of the mix, which lowers the peak combustion temperature. Since NOx is more readily formed at high temperatures, the EGR system limits the generation of NOx by keeping the temperatures low.

Most EGR systems include at least one EGR valve and optionally at least one EGR cooler connected in series between an exhaust manifold and an intake manifold of an engine. Some engines, especially compression ignition or diesel engines, use coolers that cool the portion of exhaust gas being recirculated. The cooled exhaust gas has a lower latent heat content and can aid in lowering combustion temperatures even further. In general, engines using EGR to lower their NOx emissions can attain lower emissions by cooling the recirculated exhaust gas as much as possible.

Exhaust gas constituents in the exhaust gas being recirculated to the intake manifold may present problems when the exhaust gas is cooled below a condensation temperature of those constituents. Various hydrocarbons may condense onto engine components and may present issues such as sluggish performance or even sticking of moving parts. These issues are especially evident when an engine starts under cold ambient conditions, when most engine components are cold and exhaust gas constituents condense more readily onto the engine components.

Engines in the past have attempted to cope with the problem of condensation of exhaust gas constituents by delaying initiation of EGR under cold start conditions, limiting the amount of exhaust gas being recirculated, or limiting the amount of cooling applied to the recirculated exhaust gas in an effort to minimize the degree and amount of condensates. These measures, although effective in increasing the service life of engine components and decreasing the likelihood of failures, may be insufficient in addressing the impact they have on the emissions generated by the engine. The more delayed the initiation of EGR becomes, or, the limited amount of cooling of the exhaust gas, qualitatively increases the emissions generated by the engine.

Some engine designs cope with the issue of condensation by placing the EGR valve upstream, or on the "hot side" of the EGR cooler. This placement of the EGR valve ensures that the valve will not be exposed to cooled exhaust gas, and thus be immune to the condensation effects that result from the cooling. These configurations may expose the EGR valve to high temperatures which may reduce the service life of the valve or require higher cost and/or complexity of the valve.

SUMMARY OF THE INVENTION

An exhaust gas recirculation system for an engine having an exhaust system includes an EGR cooler in fluid communication with the engine. The EGR cooler receives a portion of the engine's exhaust gas. A cooled EGR passage is downstream of the EGR cooler, and an air intake line is in fluid communication with the engine. A collecting vessel is located at or downstream of the EGR cooler for receiving condensate, and a condensate evacuation line is in fluid communication with the collecting vessel for receiving condensate from the collecting vessel.

DETAILED DESCRIPTION

Figure 1:
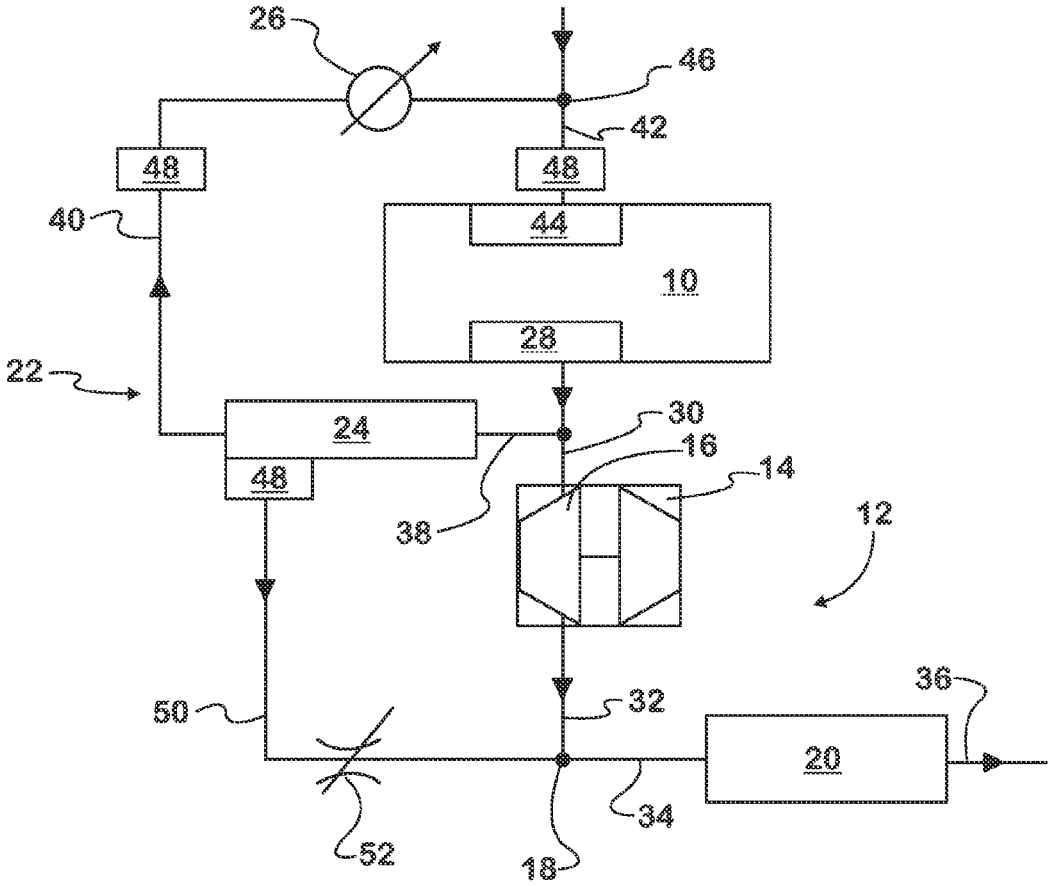
FIG. 1 is a schematic diagram of an engine having an exhaust system and an exhaust gas recirculation system.
Figure 2:
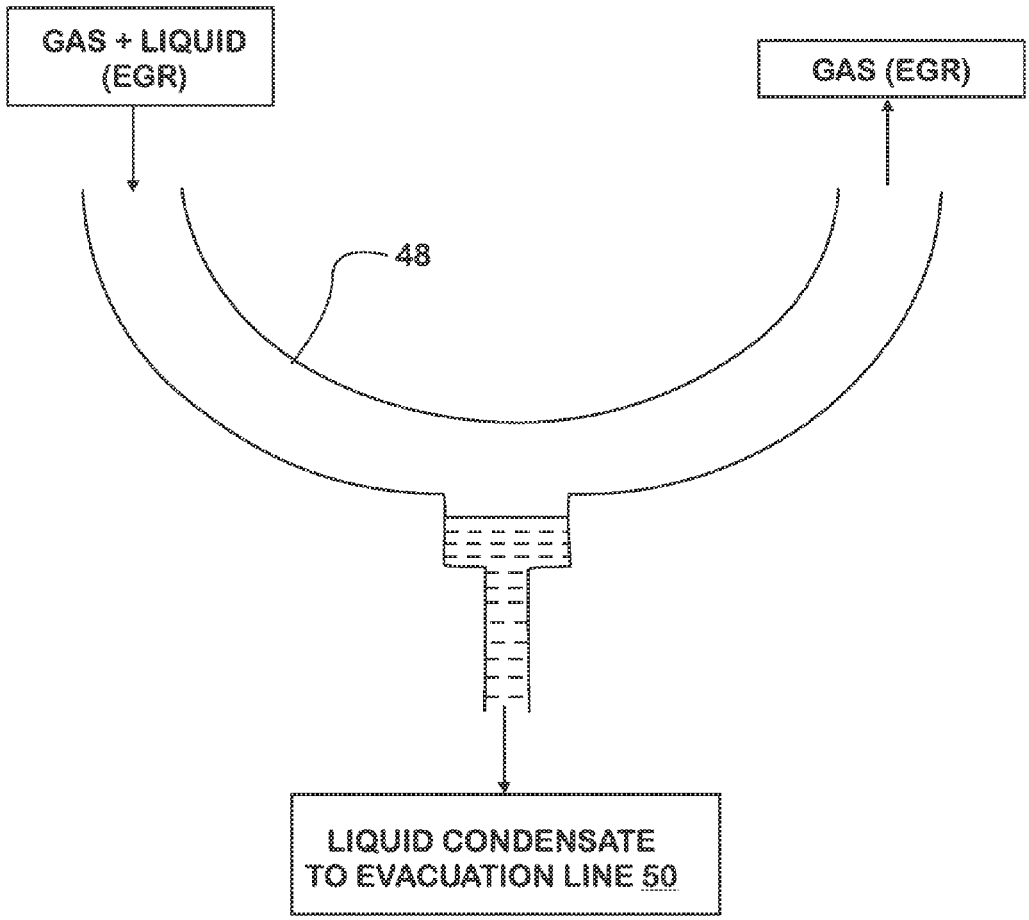
FIG. 2 is a schematic of a collecting vessel.

Referring now to FIG. 1, a schematic diagram of an engine 10 having an exhaust system, generally shown at 12, includes a turbocharger 14 having a turbine 16. Downstream of the turbine 16 is a mixer 18 and a diesel particulate filter 20. The exhaust system 12 receives a first portion of the exhaust gas from the engine 10. An exhaust gas recirculation (EGR) system, generally shown at 22, is also associated with the engine 10 and includes an EGR cooler 24 and an EGR valve 26. The EGR system 12 receives a second portion of the exhaust gas from the engine 10.

Each of the cylinders of the engine 10 are connected to the exhaust system 12 through an exhaust manifold 28 of the engine. The exhaust manifold 28 is in fluid communication with the turbine 16 of the turbocharger 14 with a first exhaust passage 30. Exhaust flow through the turbocharger 14 flows through a second exhaust passage 32 to the mixer 18. From the mixer 18, exhaust flows through the diesel particulate filter 20 on a third passage 34, and from the diesel particulate filter out an exhaust duct 36. Other components, such as a muffler, catalyst, particulate filter, and so forth, may be connected in fluid communication with the exhaust manifold 28.

A fourth exhaust passage 38 on the EGR system 22 permits the fluid communication of the exhaust manifold 28 with the EGR cooler 24. From the EGR cooler 24, the cooled exhaust gas flows to the EGR valve 26 on a cooled passage 40, which is connected to an intake air line 42 that fluidly communicates with an intake manifold 44 of the engine 10.

Air from the intake air line 42 mixes with recirculated and cooled exhaust gas from the cooled passage 40 at a junction 46. The mixture flows through the intake air line 42 towards the intake manifold 44 of the engine 10. The intake manifold 44 is fluidly connected to combustion cylinders to provide the engine with a cooled exhaust gas and air mixture. While in the cylinders, the mixture is additionally mixed with fuel and combusts, yielding useful work to the engine 10, heat and exhaust gas. The exhaust gas is collected and routed from the exhaust manifold 28 to the turbine 16, which yields work.

A portion of the exhaust gas in the exhaust system 12 bypasses the exhaust system 12 and flows to the fourth exhaust passage 38 on the EGR system 22. Exhaust gas entering the fourth exhaust passage 38 is exhaust gas that will be recirculated into the intake manifold 44. In one embodiment, the amount of recirculated exhaust gas is metered by the EGR valve 26.

The temperature of the exhaust gas that flows through the fourth exhaust passage 38 is at a temperature, T1. The temperature T1 may be about 425-degrees C., or substantially higher depending on the operating condition. After flowing through the EGR cooler 24, the exhaust gas is cooled to a temperature, T2 that is below T1, and may be about 200-degrees C. In one embodiment, more than one EGR cooler 24 can be used to cool the exhaust gases. At the temperature T2, the constituents of the exhaust gas may begin to condense.

Due to stiffening engine emissions requirements, the temperature of the exhaust gas needs to be low enough to yield combustion in the engine 10 that generates a proportion of emissions under most or all engine operating conditions. The lowered temperature is about 200-degrees C., where condensation of the exhaust gas may occur in the EGR cooler 24, the cooled passage 40, the intake air line 42, and the intake manifold 44. Further, condensation can occur at the engine 10, which may damage the engine.

To evacuate the condensation from the EGR system 22, one or more collecting vessels 48 are attached to at least one of the following components: the EGR cooler 24, the cooled passage 40, the intake air line 42, the intake manifold 44, or anywhere else between the EGR cooler and the engine 10. The collecting vessel 48 may be a liquid separator that separates liquid condensate from gas/liquid mixture. It is possible that the collecting vessel 48 can be a siphon, or may be a vortex or even centrifugal separator. It is possible that the collecting vessel 48 has a funnel-like shape, or any other shape that can collect condensate from the EGR system 22.

The collecting vessel collects the condensate under gravity feed and permits the condensate to flow through a condensate evacuation line 50 to a control orifice 52. The control orifice 52 selectively permits the condensate to flow through the condensate evacuation line 50 to the mixer 18, but prevents the flow of exhaust gas through the condensate evacuation line to the EGR cooler 24. When the condensate flows to the mixer 18, it gets vaporized in the exhaust stream downstream of the turbine 16 and upstream of the diesel particulate filter 20. The control orifice 52 is calibrated to limit the flow between the collecting vessel 48 and the outlet of the turbine 16 to the extent necessary to evacuate all condensed liquid but not EGR gas, or a limited amount of EGR gas. The evacuation of EGR gas may result in the loss of pressure and flow of the EGR intake.

The condensate is removed from the EGR system 22 by positioning at least one collecting vessel 48 in fluid communication with the EGR cooler 24, the cooled passage 40, the intake air line 42, the intake manifold 44, or anywhere else between the EGR cooler and the engine 10. The collecting vessel 48 removes the condensate from the EGR system 12. The condensate evacuation line 50 is attached in fluid communication with the collecting vessel 48 and the control orifice 52 permits the flow of condensate to the mixer 18 where the condensate is mixed and vaporized by the hot exhaust gas. The mixer 18 is located in fluid communication with the condensate evacuation line 50 and the exhaust system 12 to mix the condensate with exhaust gas upstream of the diesel particulate filter 20. In one embodiment, there are multiple collecting vessels 48 and multiple condensate evacuation lines 50 that are in fluid communication with the exhaust system 12.

What is claimed is:

1. A system for removal of condensate from an EGR system in fluid communication with an engine and a non-recirculated exhaust system, the condensate removal system comprising:

an exhaust manifold of the engine;

a turbine disposed in fluid communication and downstream of the exhaust manifold on a first exhaust passage and receiving a first portion of the engine's exhaust gas that is non-recirculated;

a mixer disposed in fluid communication and downstream of the turbine on a second exhaust passage receiving the first portion of the engine's exhaust gas that is non-recirculated, wherein the second exhaust passage is downstream of the first exhaust passage;

a diesel particular filter in fluid communication and downstream of the mixer on a third passage, wherein the third passage is downstream of the second passage;

an EGR cooler in fluid communication and downstream of the engine on an exhaust passage receiving a second portion of the exhaust gas that is recirculated;

a cooled EGR passage downstream of the EGR cooler, wherein the EGR passage receives the second portion of the exhaust gas that is recirculated;

an air intake line in fluid communication with the engine and selective fluid communication with the cooled EGR passage, wherein the mixer is fluidly non-communicable with the air intake line;

an EGR valve downstream of the EGR cooler on the cooled EGR passage, wherein the EGR valve selectively permits the flow of the second portion of the recirculated exhaust gas into the air intake line;

a collecting vessel located at or downstream of the EGR cooler;

a condensate evacuation line in fluid communication with the collecting vessel for receiving condensate from the collecting vessel and permitting the flow of condensate to the mixer; and a control orifice located on the condensate evacuation line for selectively permitting the flow of condensate to the mixer, but preventing flow of the first portion of exhaust gas through the condensate evacuation line to the EGR cooler, wherein the mixer mixes the condensate with the first portion of exhaust gases from the turbine and vaporizes the condensate.

2. The system of claim 1 wherein the EGR cooler cools the first portion of exhaust gas from a first temperature to a second temperature that is about or below 200 degrees C.

3. The system of claim 1 wherein the collecting vessel receives condensate under gravity feed.

4. The exhaust gas recirculation system of claim 1 wherein the collecting vessel is attached to one of the EGR cooler, the cooled EGR passage, and the air intake line.

5. The exhaust gas recirculation system of claim 1 wherein air is introduced into the intake air line and mixes with recirculated and cooled exhaust gas from the cooled passage downstream of the EGR cooler.

6. The exhaust gas recirculation system of claim 1 wherein the mixture of air and recirculated and cooled exhaust gas flows through the intake air line to the intake manifold.

* * * * *